US010099097B2

(12) United States Patent
Breeden, III et al.

(10) Patent No.: US 10,099,097 B2
(45) Date of Patent: Oct. 16, 2018

(54) GOLF CLUB GRIP

(71) Applicant: Winston Products LLC, Cleveland, OH (US)

(72) Inventors: Winston H. Breeden, III, Chagrin Falls, OH (US); Nick Giannatti, Hudson, OH (US); Ron F. Giannatti, Highland Heights, OH (US); Charles Eugene Spain, Cameron, NC (US)

(73) Assignee: WINSTON PRODUCTS, LLC, Cleveland, OH (US)

( * ) Notice: Subject to any disclaimer, the term of this patent is extended or adjusted under 35 U.S.C. 154(b) by 0 days.

(21) Appl. No.: 15/248,654

(22) Filed: Aug. 26, 2016

(65) Prior Publication Data

US 2017/0165543 A1 Jun. 15, 2017

Related U.S. Application Data

(60) Provisional application No. 62/310,151, filed on Mar. 18, 2016, provisional application No. 62/267,016, filed on Dec. 14, 2015.

(51) Int. Cl.
*A63B 53/14* (2015.01)

(52) U.S. Cl.
CPC ..... *A63B 53/14* (2013.01)

(58) Field of Classification Search
CPC ..... A63B 53/14
See application file for complete search history.

(56) References Cited

U.S. PATENT DOCUMENTS

| | | | | |
|---|---|---|---|---|
| 5,839,983 | A * | 11/1998 | Kramer | A63B 60/12 473/457 |
| 2001/0041626 | A1* | 11/2001 | Madelle | A63B 53/14 473/295 |
| 2002/0107088 | A1* | 8/2002 | Lamkin | A63B 53/14 473/300 |
| 2003/0104875 | A1 | 6/2003 | Markwood | |
| 2006/0264267 | A1* | 11/2006 | Fox | A42B 1/062 473/300 |
| 2007/0173342 | A1 | 7/2007 | Turnpaugh | |
| 2010/0077568 | A1* | 4/2010 | Gill | A63B 49/08 16/421 |
| 2013/0065703 | A1* | 3/2013 | Rose | A63B 69/3632 473/223 |
| 2013/0130825 | A1* | 5/2013 | McLoughlin | A63B 53/14 473/303 |
| 2014/0090770 | A1* | 4/2014 | Huang | A01K 87/08 156/93 |

FOREIGN PATENT DOCUMENTS

| | | |
|---|---|---|
| JP | 09206414 | 8/1997 |

* cited by examiner

*Primary Examiner* — Michael Dennis
(74) *Attorney, Agent, or Firm* — Tucker Ellis LLP

(57) ABSTRACT

Provided is a grip for a golf club having a body with an axial passage extending substantially the length of the body and an air passage extending through a side wall of the body into the axial passage to allow air to escape from the axial passage as the shaft of the golf club is advanced into the axial passage.

19 Claims, 16 Drawing Sheets

GOLF CLUB GRIP

RELATED APPLICATIONS

This application claims the benefit of U.S. Provisional Application No. 62/267,016 filed Dec. 14, 2015 and U.S. Provisional Application No. 62/310,151 filed Mar. 18, 2016, which are hereby incorporated herein by reference.

FIELD OF INVENTION

The present invention relates generally to a grip, and more particularly to a golf club grip for a putter.

BACKGROUND

Golf club grips, and in particular putter grips can be provided in a variety of shapes and sizes. The putter grips are installed onto shafts of golf clubs and secured in any suitable manner. A golfer can use a variety of grip placements when positioning her hands on the putter grip, such as traditional, left-hand low, saw, and claw.

SUMMARY OF INVENTION

The present application provides a grip for a golf club, such as a putter, having a body with an axial passage extending substantially the length of the body and an air passage extending through a side wall of the body into the axial passage to allow air to escape from the axial passage as the shaft of the golf club is advanced into the axial passage.

In an embodiment, a grip for a golf club may be provided that includes a grip portion having first and second ends with a pair of longitudinally extending parallel flat sides each joined to a pair of longitudinally extending curved sides and having a bore extending longitudinally through the grip portion for a shaft of the golf club, a taper portion adjacent to the first end of the grip portion tapering away from the grip portion and having a bore in communication with the bore of the grip portion, and an end portion adjacent to the second end of the grip portion, and a wrap surrounding the grip portion, the wrap having an outer surface substantially flush with an adjacent outer surface of the taper portion and an adjacent outer surface of the end portion, wherein the taper portion and the end portion each have a cross-sectional area adjacent the first and second ends of the grip portion respectively that is greater than a cross-sectional area of the grip portion.

In another embodiment a golf club grip may be provided that includes an elongate body having an axial length, first and second ends, and an opening at the first end, an axial passage within the body extending substantially the length of the body, the passage having a first end that opens to the opening at the first end of the body to allow a shaft of a golf club to be advanced into the axial passage and a second end that is closed at the second end of the body, and an air passage extending through a side wall of the body into the axial passage to allow air to escape from the axial passage as the shaft of the golf club is advanced into the axial passage.

According to still another embodiment, a grip is provided that includes an elongate body substantially obround in shape having an axial length, first and second ends, and an opening at the first end, an axial passage within the body extending substantially the axial length of the body, the passage having a first end that opens to the opening at the first end of the body and a second end that is closed preventing air from escaping at the second end, and an air passage extending through a side wall of the body adjacent the second end of the body into the axial passage to allow air to escape from the axial passage.

The foregoing and other features of the application are described below with reference to the drawings.

DETAILED DESCRIPTION

The principles of the present application relate to a grip for a golf club, such as a putter, and thus will be described below in this context. It will be appreciated that the principles of the application may be applicable to grips for other activities, such as baseball, tennis, etc.

Figure 22:
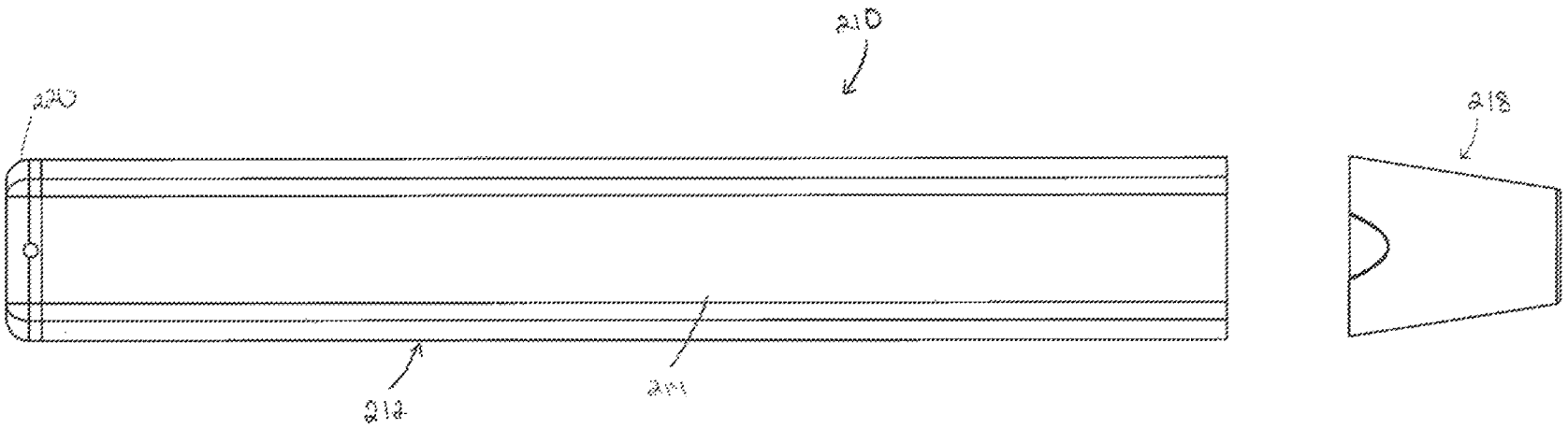
FIG. 22 is a front view of a golf club grip and the grip accessory.

Turning now to FIGS. 1-13, a golf club grip is shown generally at reference numeral 10. The grip includes a body 12 and a wrap 14 surrounding a portion of the body. Alternatively, it will be appreciated that grip 10 may be formed as one piece. The body 12 includes a grip portion 16 providing an area for a golfer to grip, a taper portion 18 to prevent the grip 10 from catching in a golf bag when being removed, and an end portion 20. The grip portion 16, taper portion 18, and end portion 20 can be formed as one piece, for example as shown in FIGS. 1-13, and of any suitable material such as EVA foam injected into a mold. Alternatively, the grip portion 16, taper portion 18, and/or end portion 20 can be formed as separate pieces, for example as shown in FIG. 22.

Figure 11:
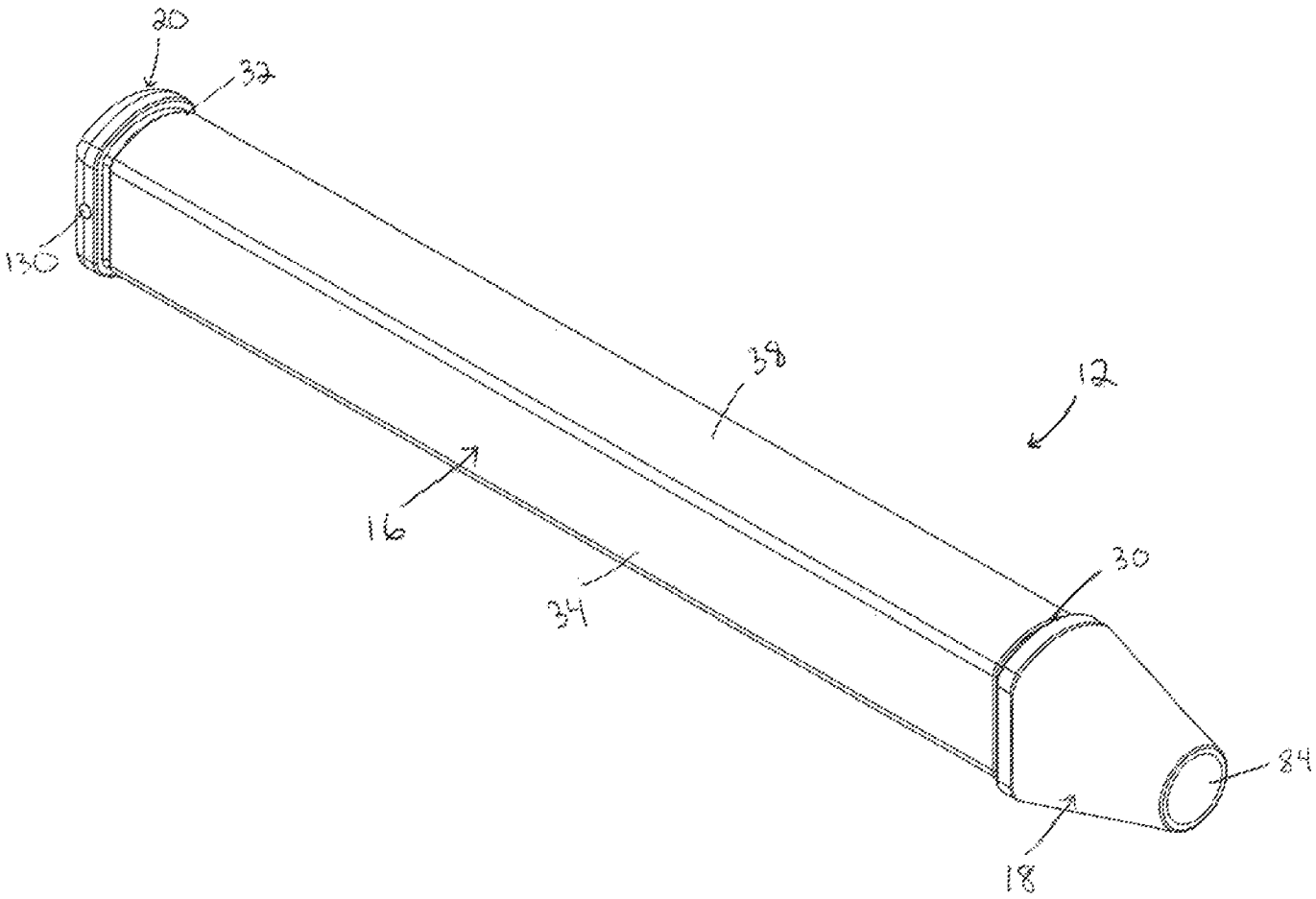
FIG. 11 is a perspective view of the grip with a wrap removed.
Figure 12:
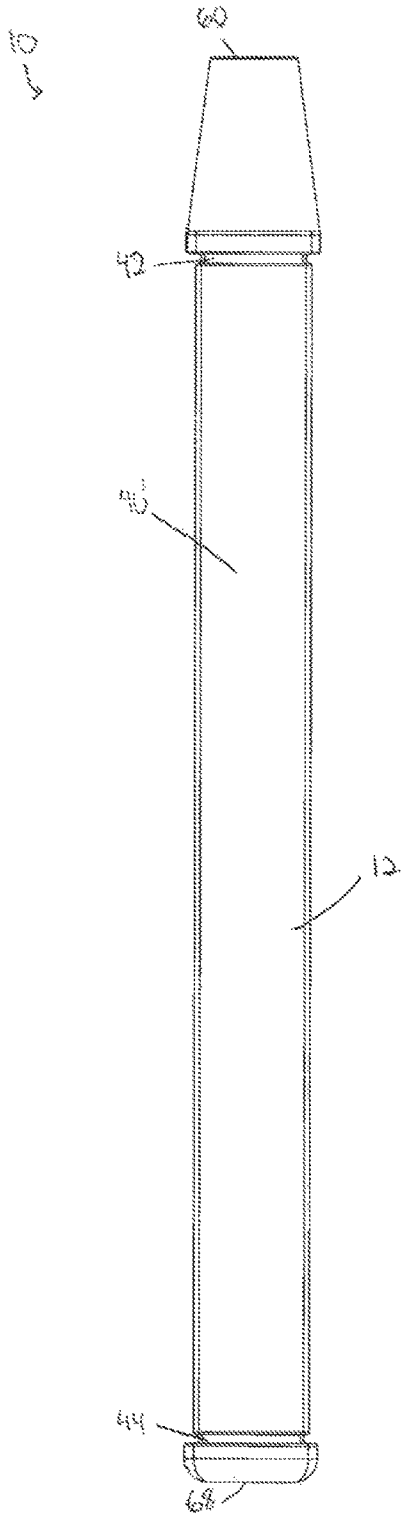
FIG. 12 is a bottom view of the grip with the wrap removed.
Figure 13:
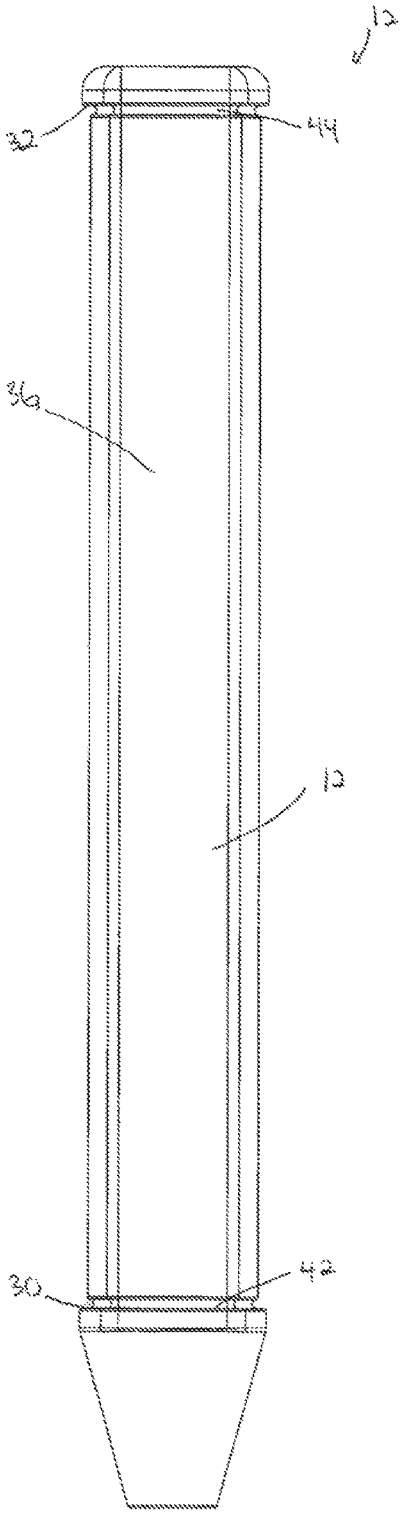
FIG. 13 is a rear view of the grip with the wrap removed.
Figure 14:
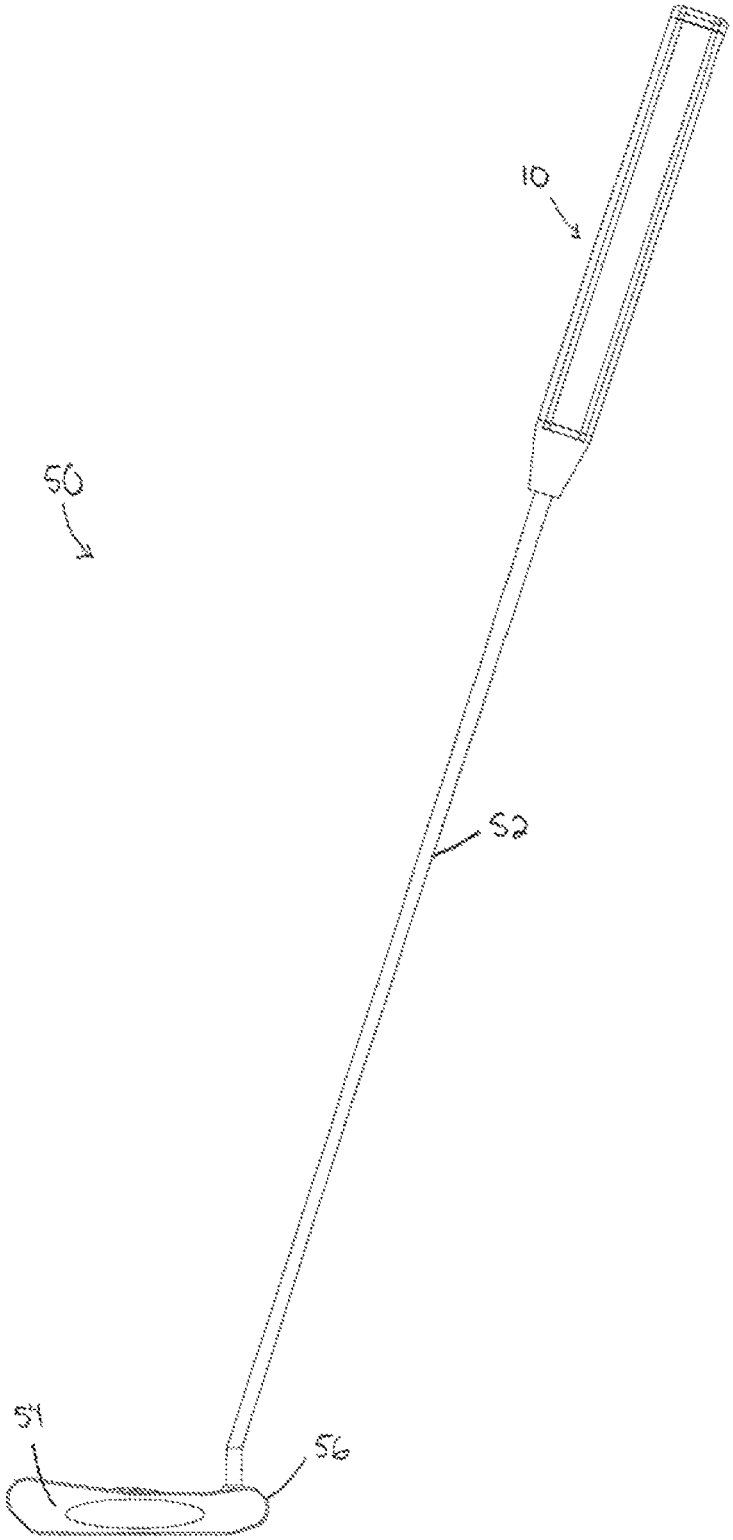
FIG. 14 is a perspective view of a putter with the golf club grip attached.

As shown in FIGS. 11-13, the grip portion 16 has first and second ends 30 and 32 and a pair of longitudinally extending parallel flat sides 34 and 36 each joined to a pair of longitudinally extending curved sides 38 and 40. The grip portion 16 also includes first and second grooves 42 and 44 at the first and second ends 30 and 32 respectively. The grip portion 16 when viewed from an end view is substantially obround or double D shaped such that it has two parallel lines of equal length and two arcs on each end whose chords are either a full diameter or less than a full diameter. As shown, the chords are less than a full diameter. When installed on a shaft 52 of a putter 50 as shown in FIG. 14, the parallel flat sides 34 and 36 are parallel to a plane of a face 54 of a putter head 56 of the putter 50 such that when gripped by a user, the putter face 54 and the user's hands and shoulders are square to the intended target line. The design of the grip allows the user to grip the putter in a preferred manner, such as traditional, left-hand low, saw, claw, etc.

The taper portion 18 is adjacent the first end of the grip portion 16 and includes first and second ends 60 and 62 and an alignment device 64 for aligning the grip 10 with the putter 50 during installation. The taper portion 18 tapers away from the grip portion from the second end 62 to the first end 60. The end portion 20 is adjacent the second end of the grip portion 16 and includes first and second ends 66 and 68. The end view of the taper portion 18 and the end portion 20 are also substantially obround or double D shaped.

The taper portion 18 at its second end 62 and the end portion 20 at its first end 66 each have a cross-sectional area that is greater than a cross-sectional area of the grip portion 16. In this way, when the wrap 14 is installed on the body 12 to surround the grip portion 16, an outer surface of the wrap 14 is substantially flush with the second end 62 of the taper portion 18 and the first end 66 of the end portion 20. The wrap can be secured around the grip portion 16 in any suitable manner, such as by stitching sides of the wrap together as shown by reference numeral 70 in FIG. 4, and ends of the wrap 14 are received in the first and second grooves 42 and 44 of the grip portion 16 and secured by an adhesive to prevent flaring of the wrap 14 at its ends. Alternatively, the wrap may be a rubber grip that slides or rolls onto the body 12 or a rubber grip having ends joined by heating or melting and then stretched over the body 12.

Figure 1:
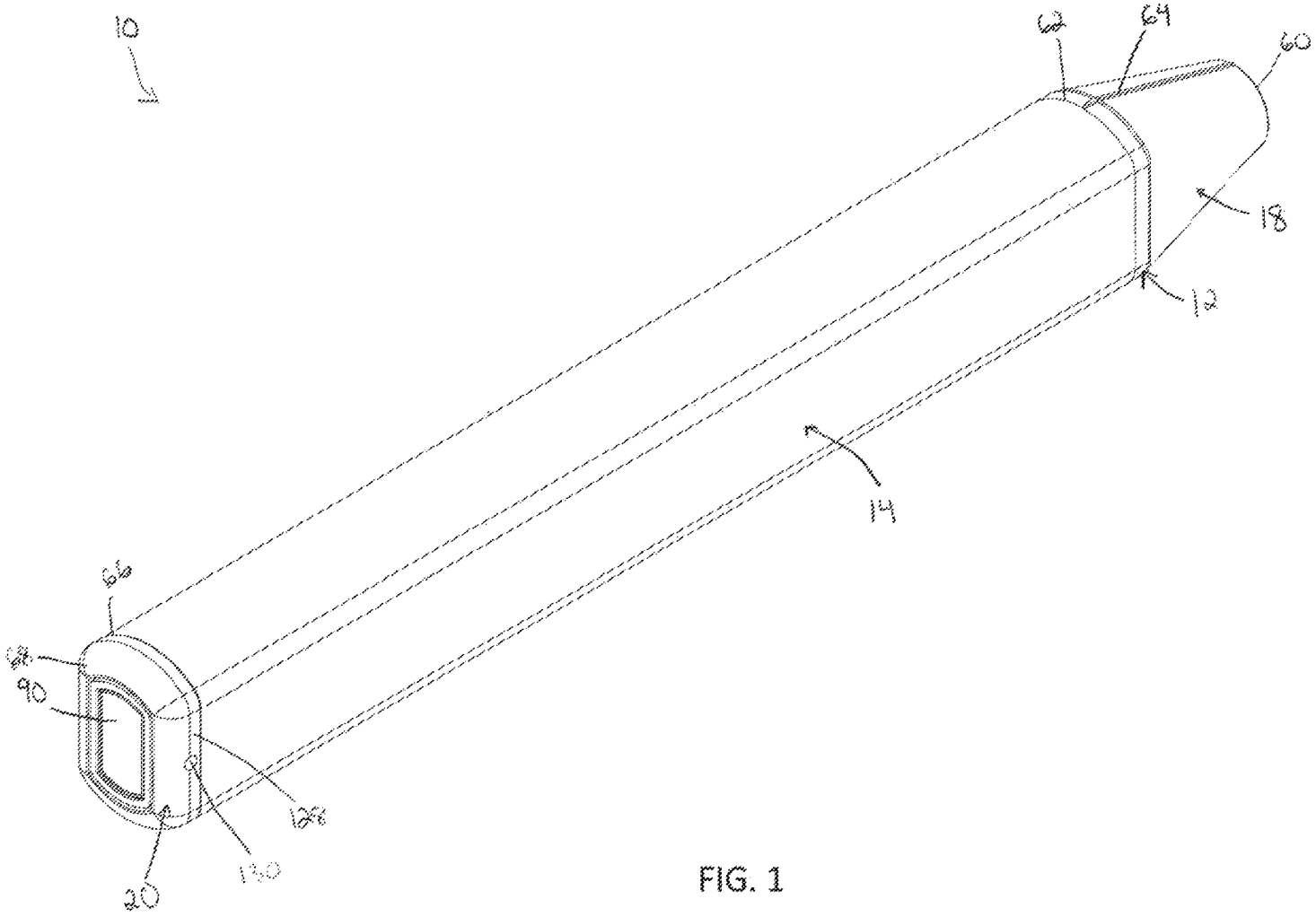
FIG. 1 is a perspective view of an exemplary golf club grip.
Figure 2:
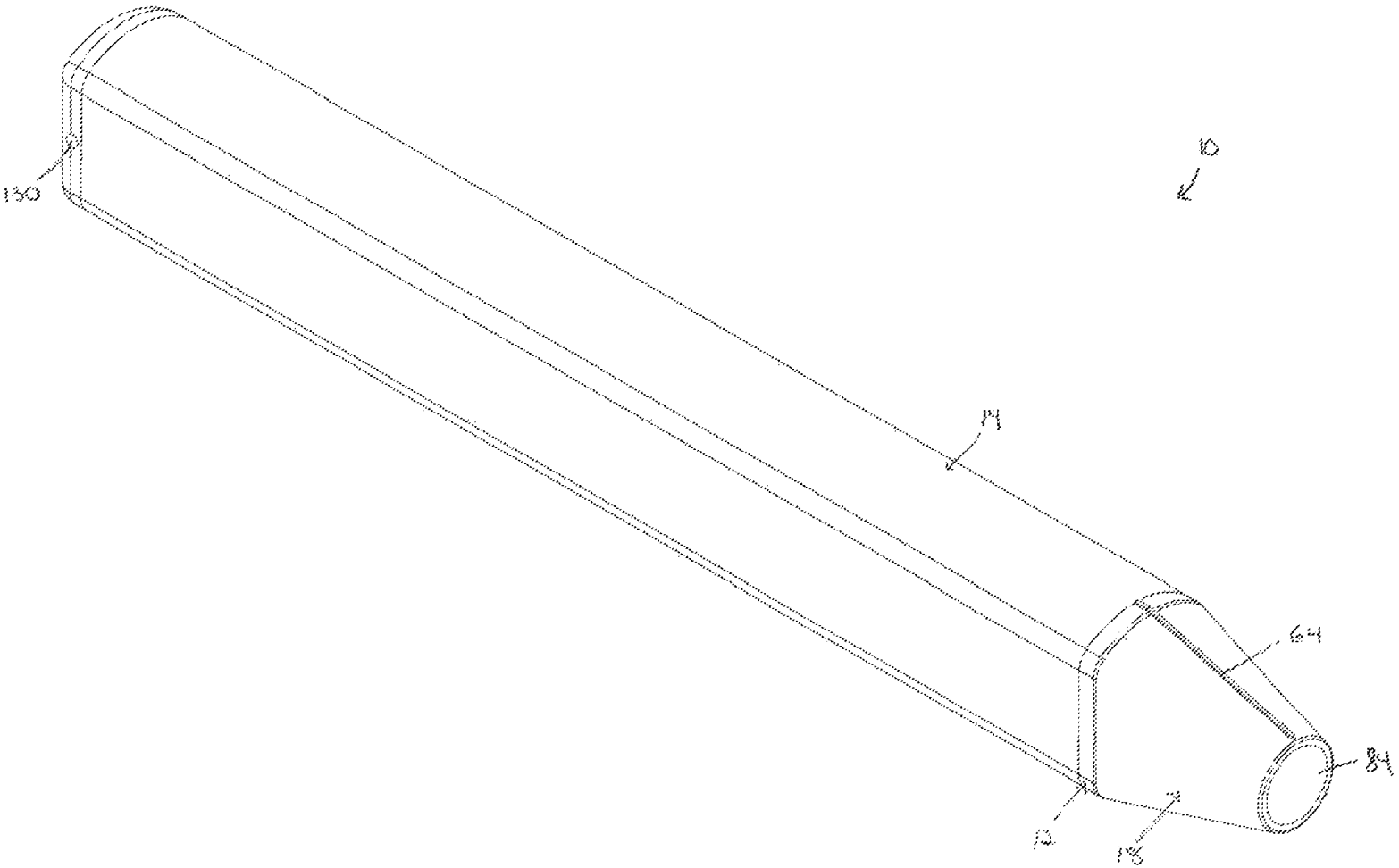
FIG. 2 is another perspective view of the grip.
Figure 3:
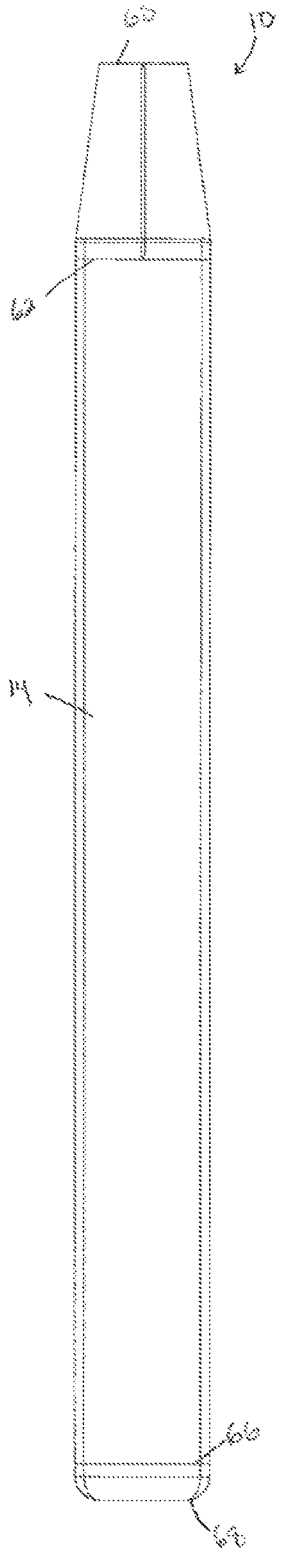
FIG. 3 is a top view of the grip.
Figure 4:
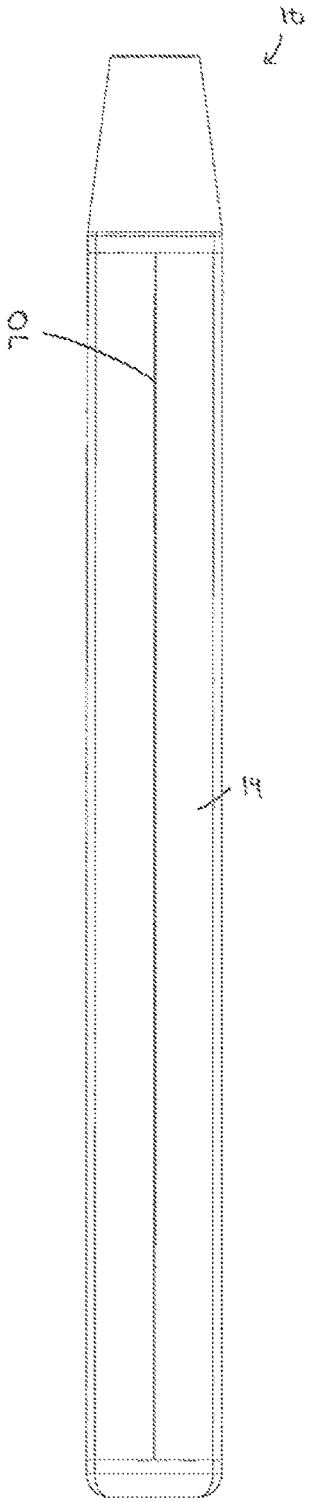
FIG. 4 is a bottom view of the grip.
Figure 5:
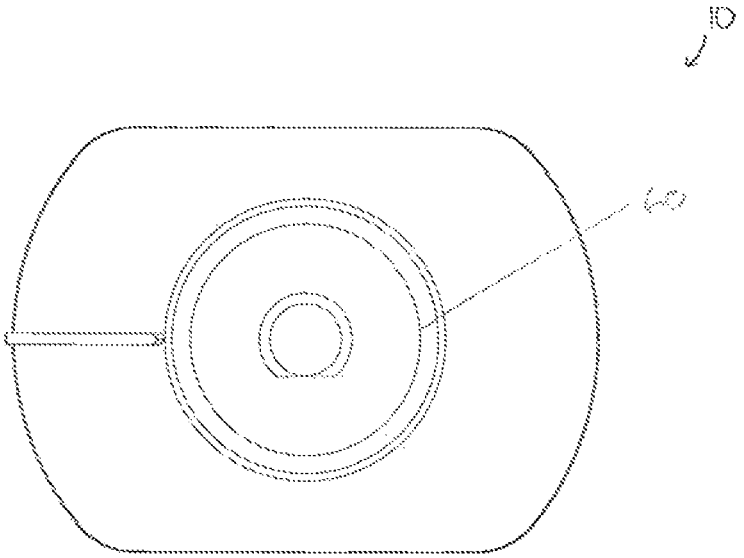
FIG. 5 is a right side view of the grip.
Figure 6:
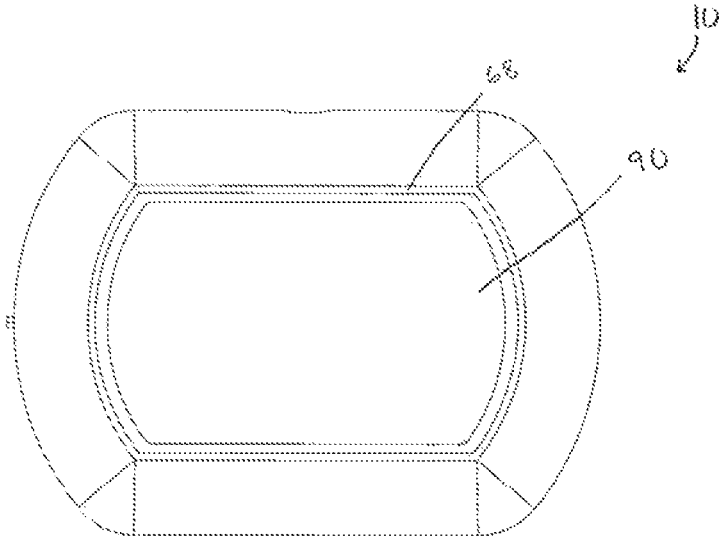
FIG. 6 is a left side view of the grip.
Figure 7:
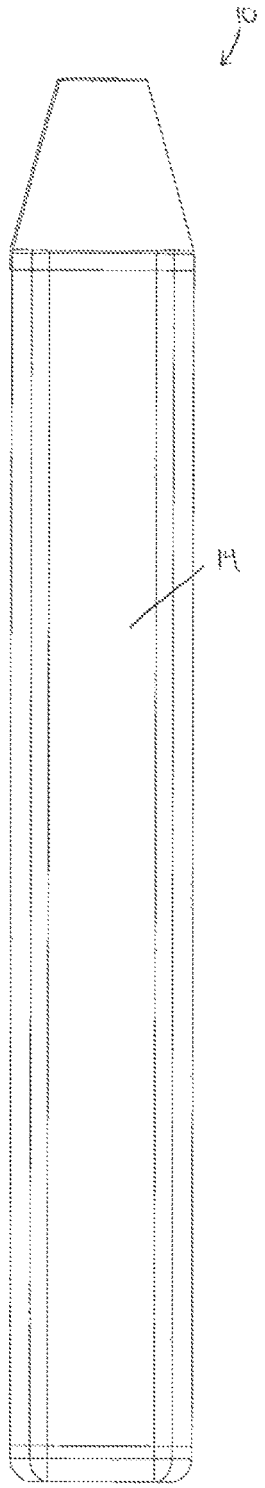
FIG. 7 is a front view of the grip.
Figure 8:
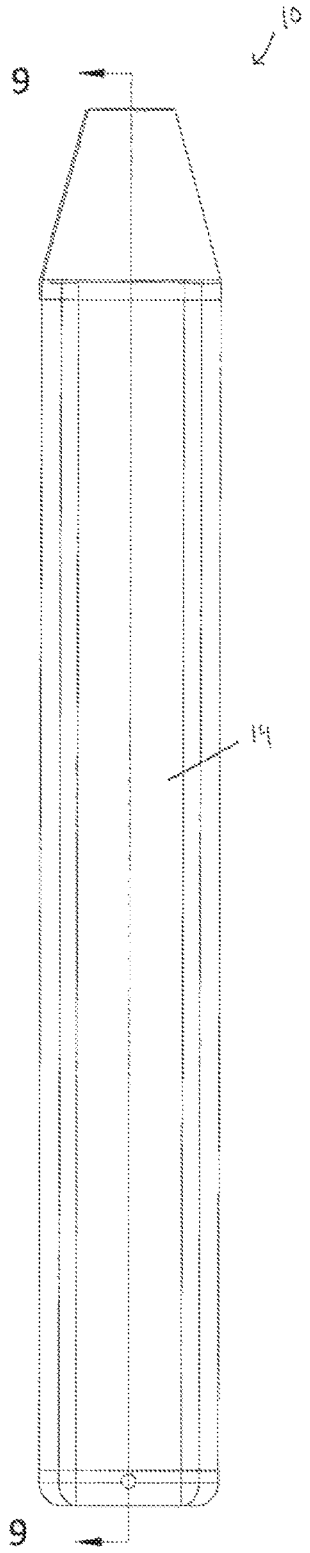
FIG. 8 is a rear view of the grip.
Figure 9:
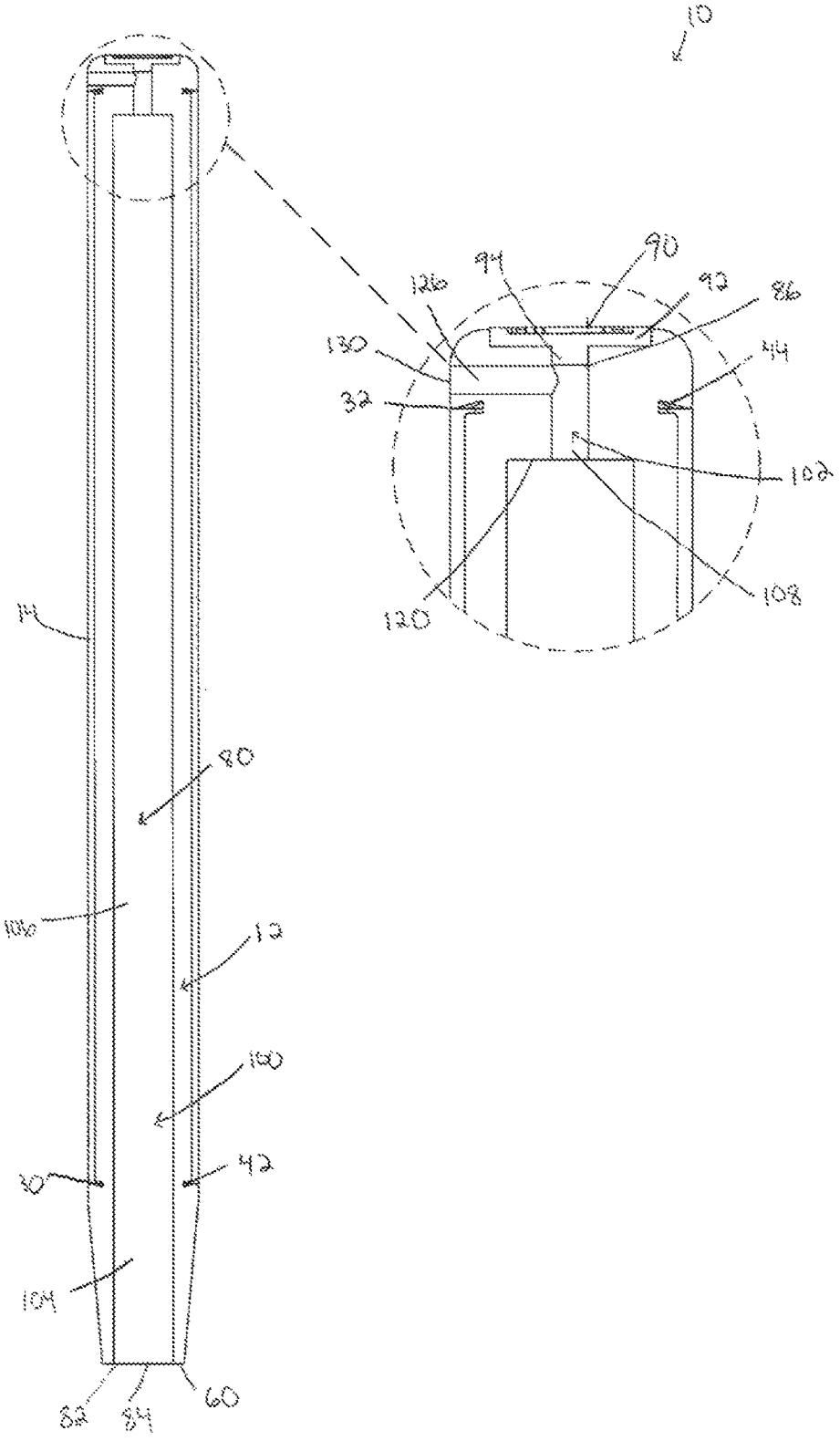
FIG. 9 is a cross-sectional view taken about line 9-9 in FIG. 8.
Figure 10:
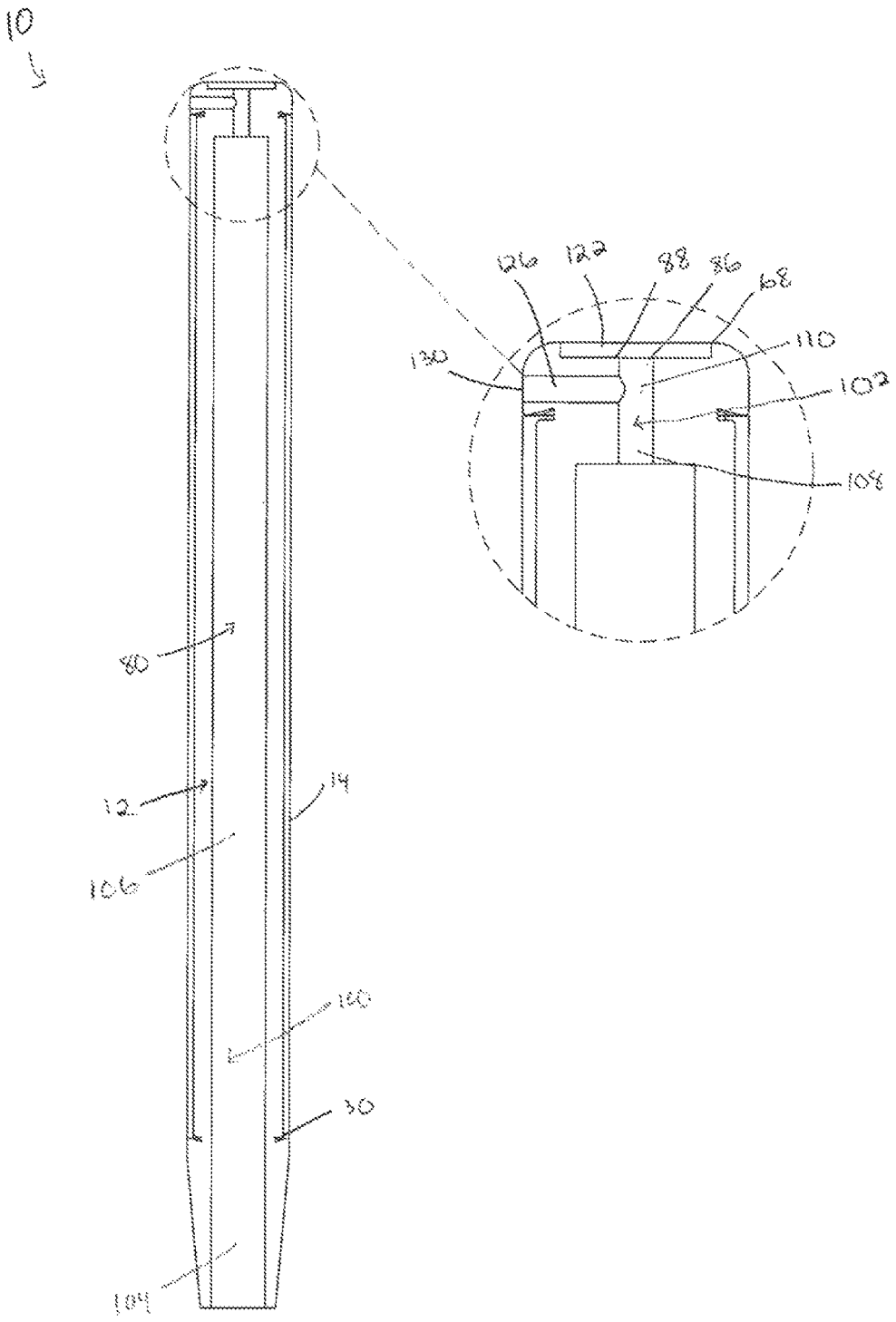
FIG. 10 is another cross-sectional view with an end plug removed.

As shown in FIGS. 9 and 10, the body 12 includes a bore 80 or axial passage within the body 12 and extending the length of the body 12. The bore has a first end 82 that opens to an opening 84 at the first end 60 of the taper portion 18, and a second end 86 that is closed. For example, the bore 80 opens to an opening 88 at the second end 66 of the end portion 20 as shown in FIG. 10 and is closed by a plug 90 as shown in FIG. 9 and discussed in detail below.

The bore 80 includes a first bore 100 or axial passage extending longitudinally through the grip portion 16 and taper portion 18 for receiving the shaft 52 of the golf club 50, and a second bore 102 or axial passage extending longitudinally through a part of the grip portion 16 and the end portion 20. The first bore 100 is in communication with the second bore 102. The first bore 100 has a first diameter substantially equal to a diameter of the shaft 52 and the second bore 102 has a second diameter less than the first diameter. The first bore 100 includes a taper bore portion 104 within the taper portion 18 and a grip bore portion 106 within the grip portion 16, and the second bore 102 includes a grip bore portion 108 within the grip portion 16 and an end bore portion 110 within the end portion 20.

A shoulder 120 is provided in the grip bore portion 106 of the first bore 100 near the second end 32 of the grip portion 16 that defines an end of the first bore 100 and serves as a stop for an end of the shaft 52 of the golf club 50. A counterbore 122 is provided in the end portion 20 at the second end 68 in communication with the second bore 102, and in particular the end bore portion 110 of the second bore 102. The counterbore 122 and the end bore portion 110 receive the plug 90 that closes the second bore 102 to prevent fluid from escaping the end portion 20. The plug 90 has a first portion 92 with a geometry that matches a geometry of the counterbore 122 to close the counterbore, and a second portion 94 with a geometry matching the geometry of the end bore portion 110. As illustrated, the counterbore 122 is substantially obround or double D shaped, the first portion 92 of the plug 90 is substantially obround or double D shaped, and the second portion 94 of the plug 90 is substantially cylindrical. Alternatively, the second bore 102 could extend out to the second end 68 and the counterbore eliminated, or the grip could be closed at the second end 68 and the plug 90 eliminated.

To allow fluid to escape the end portion 20 as the shaft 52 of putter 50 is advanced into the bore 80, the end portion 20 includes a vent passage 126 in communication with the end bore portion 110. The vent passage 126 opens to an opening 130 and extends through a side wall 128 of the end portion 20 into the end bore portion 110, and as illustrated, the vent passage 126 is substantially perpendicular to the end bore portion 20. The second portion 94 of the plug 90 is sized so that it does not block the vent passage's communication with the end bore portion 110, and sized such that it does not provide an area past the vent passage 126 towards the second end 68 for solvent to gather when the grip 10 is being installed. By providing the vent passage 126 in the side wall 128 of the grip 10 rather than through the end of grip 68 coaxial with the bore 102, the plug 90 may be provided with an uninterrupted area for indicia, the opening 130 is easier to cover with a finger than when at end of a club, and spray through the opening 130 is not directed at the installer.

Referring to FIG. 14, to install the grip 10 onto the putter 50, a two sided tape is adhered to an end of the shaft 52 and then a solvent is applied to the tape and injected into the opening 84 in the taper portion 18. The openings 84 and 130 are then covered and the grip 10 shaken to coat the bores with solvent. The shaft 52 is then advanced through the opening 84 longitudinally through the first bore 100 until an end of the shaft 52 abuts the shoulder 120. As the shaft 52 is advanced, excess solvent and air pass through the first and second bores 100 and 102 and exits the grip 10 via the opening 130 of the vent passage 126. The grip 10 is also aligned with the face 54 of the putter 50, for example using the alignment device 64, such that the sides 30 and 32 are parallel to the face 54.

Turning now to FIGS. 15-21, an exemplary embodiment of the taper portion of the grip is shown at 218. The taper portion 218 is substantially the same as the above-referenced taper portion 18, and consequently the same reference numerals but indexed by 200 are used to denote structures corresponding to similar structures in the portions. In addition, the foregoing description of the taper portion 18 is equally applicable to the taper portion 218 except as noted below.

Figure 15:
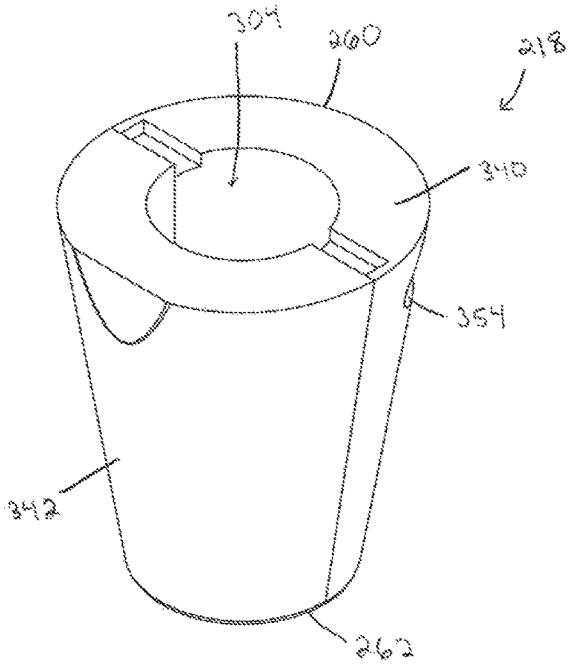
FIG. 15 is a perspective view of an exemplary grip accessory.
Figure 16:
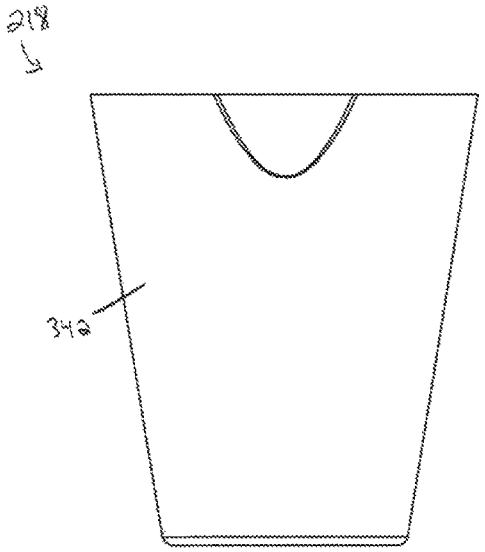
FIG. 16 is a front view of the grip accessory.
Figure 17:
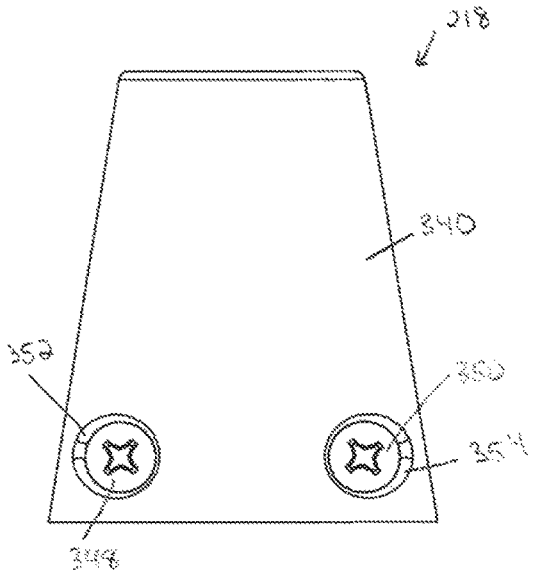
FIG. 17 is a rear view of the grip accessory.
Figure 18:
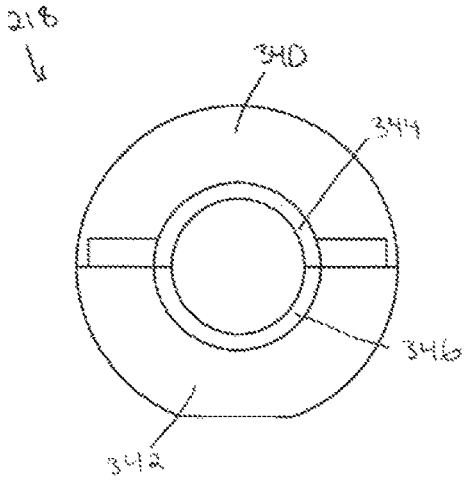
FIG. 18 is a top view of the grip accessory.
Figure 19:
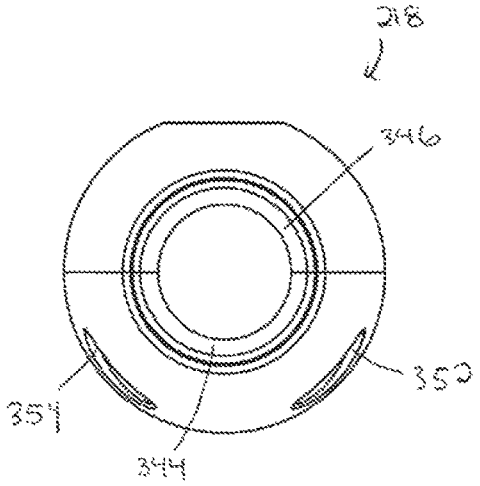
FIG. 19 is a bottom view of the grip accessory.
Figure 20:
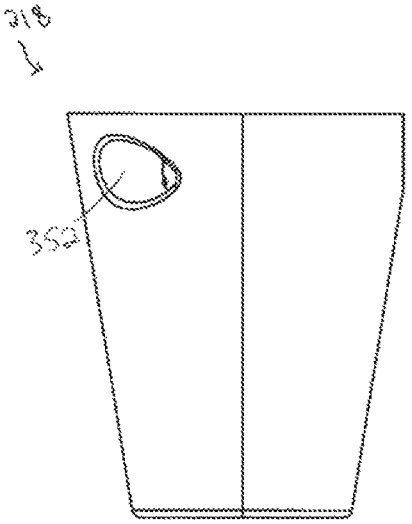
FIG. 20 is a left side view of the grip accessory.
Figure 21:
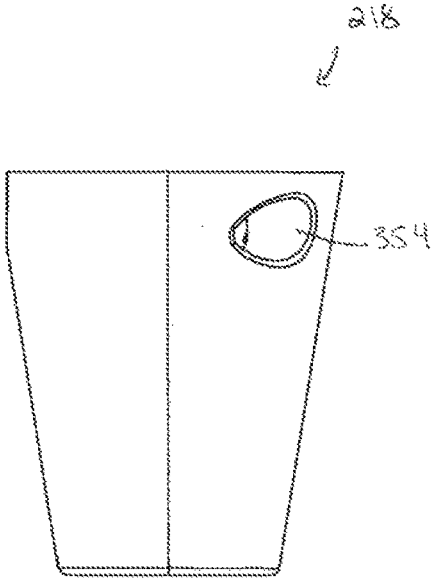
FIG. 21 is a right side view of the grip accessory.

Referring now to FIGS. 15 and 22, the taper portion 218 is formed as a separate piece from a grip body 212 of a grip 210, which includes a grip portion surrounded by a wrap 214 and an end portion 220, or alternatively the grip body may be a one-piece design without a separate wrap and end portion. The grip body can be installed on the putter as discussed above, and then the taper portion 218 can be attached to the grip body 212 and/or shaft of the putter. The taper portion 218 prevents the large flat at the first end of the grip body 212 from getting caught in a golf bag.

The taper portion 218 has a first end 260 with a round geometry and a second end 262 that is adjacent a first end of the grip body 212 with a geometry substantially matching a geometry of the grip body 212, and a bore 304 extending through the taper portion 218. The taper portion 218 tapers away from the grip body 212 from the second end 262 to the first end 260. The taper portion 218 includes first and second halves 340 and 342 that are connected together around the shaft of the putter to define the bore 304. The halves 340 and 342 may be made of a suitable material, such as plastic, and that may be lined with a lining 344 and 346 respectively, shown in FIGS. 18 and 19, that may be a suitable material such as foam that compresses during installation to allow the taper portion 218 to fit on putter shafts of various outside diameters.

The first and second halves 340 and 342 may be connected around the putter by fasteners 348 and 350 received in counterbores 352 and 354 respectively in the first halve that allow the halves 340 and 342 to have a smooth outside diameter and smooth transition from the grip 210 to the shaft. Alternatively, the halves may be connected by adhesive, snapping features, a twist lock, etc. The length of the taper portion 218 may be adjusted to increase or decrease the diameter of the taper portion 218 at the second end 262, for example by peeling away layers, snapping off sections, removing extending layers, etc., and these portions may be reinstalled.

Figure 23:
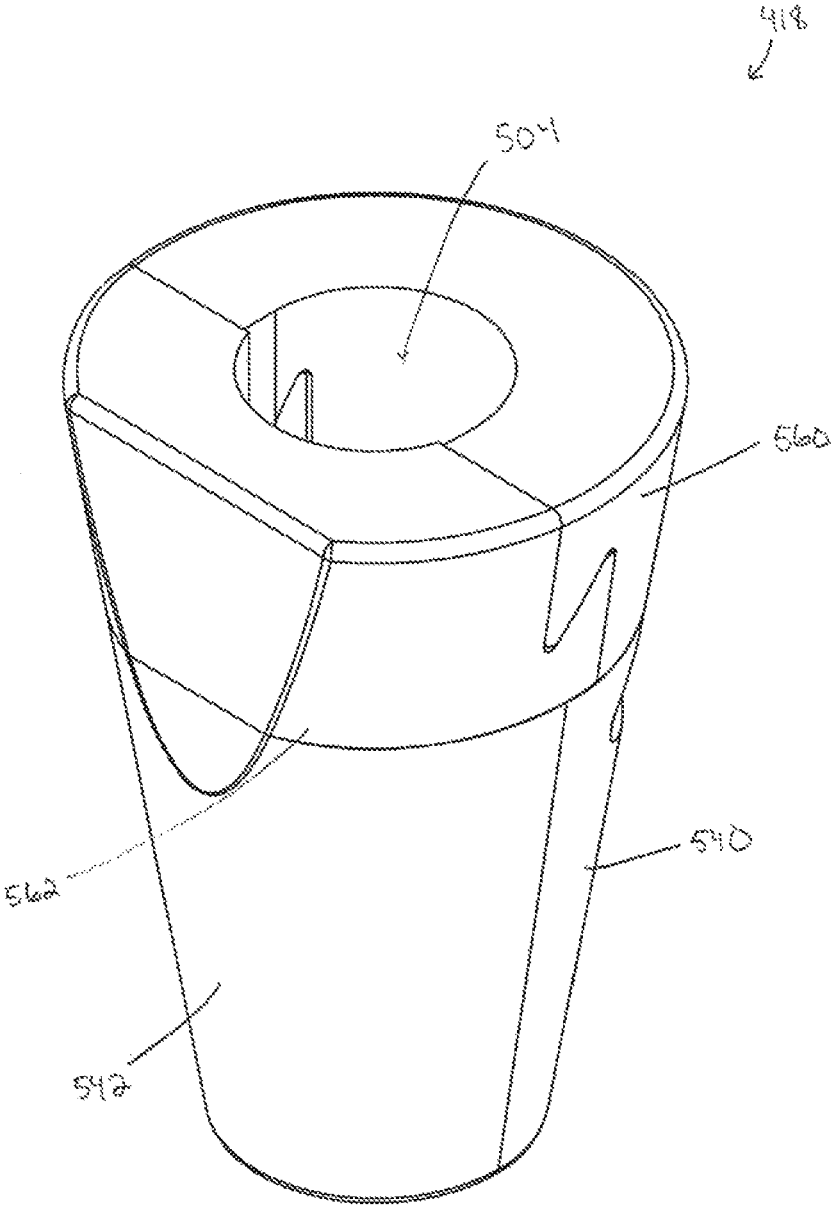
FIG. 23 is a perspective view of another exemplary grip accessory.
Figure 24:
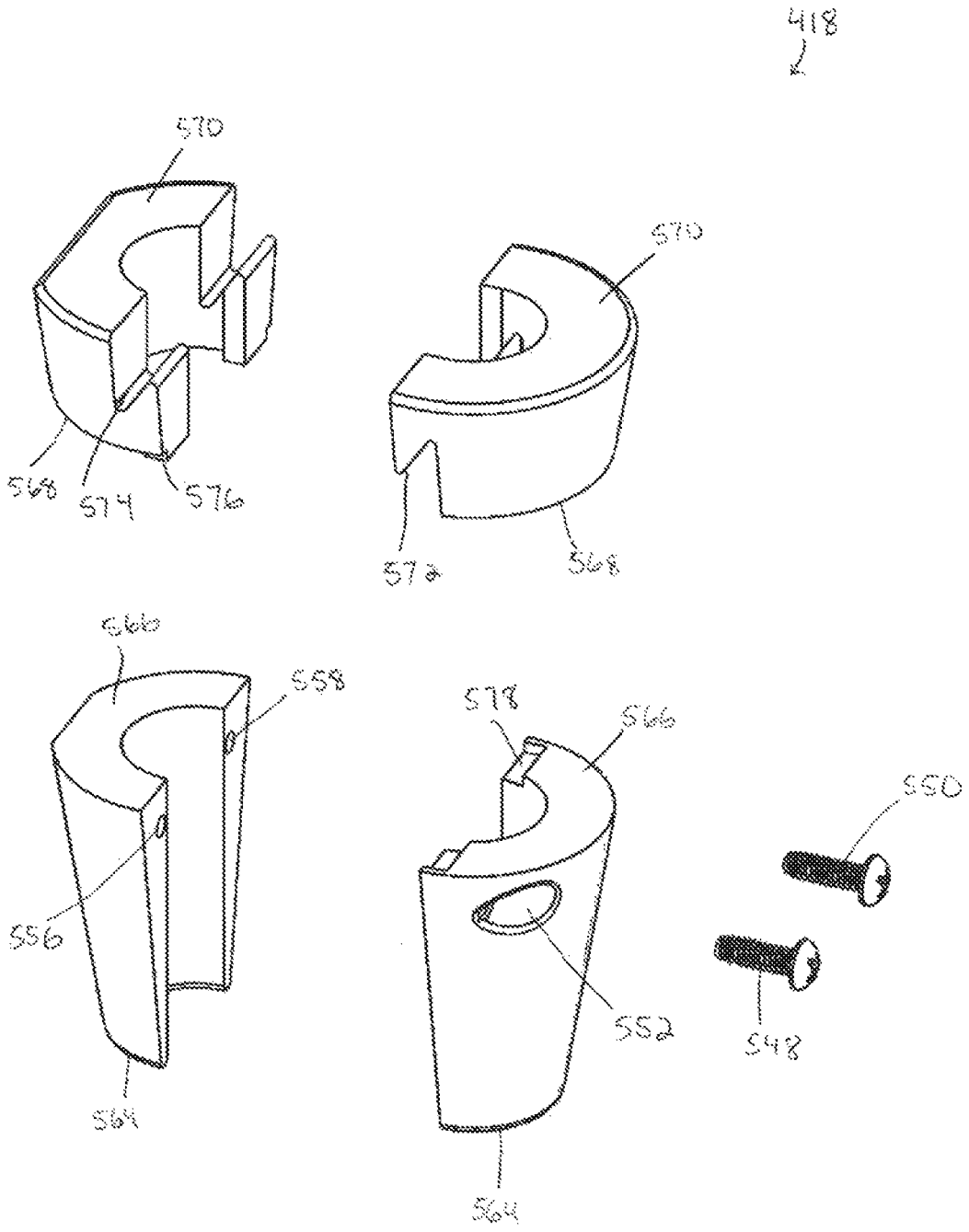
FIG. 24 is an exploded view of the grip accessory of FIG. 23.

Turning now to FIGS. 23 and 24, an exemplary embodiment of the taper portion of the grip is shown at 418. The taper portion 418 is substantially the same as the above-referenced taper portion 218, and consequently the same reference numerals but indexed by 200 are used to denote structures corresponding to similar structures in the portions. In addition, the foregoing description of the taper portion 218 is equally applicable to the taper portion 418 except as noted below.

The taper portion 418 includes a lower portion having first and second halves 540 and 542 that are connected together around the shaft of the putter and an upper portion having third and fourth halves 560 and 562 that are connected together around the shaft of the putter. The first and second halves 540 and 542 have first and second ends 564 and 566 and the third and fourth halves 560 and 562 have first ends 568 that engage and abut the second ends 566 of the first and second halves 540 and 542 and second ends 570 that are adjacent a first end of the grip with a geometry substantially matching a geometry of the grip. The first, second, third, and fourth halves 540, 542, 560, and 562 define a bore 504 extending through the taper portion 418. The third and fourth halves may have any suitable geometry at the second end 570, such a round, isosceles right pentagon, square, etc., and a round geometry at the first end 568

The first and second halves 540 and 542 may be connected around the putter by fasteners 548 and 550. The fastener 548 is received in a counterbore 552 in the first halve 540 and in an opening 556 in the second halve 542, and the fastener 550 is received in a counterbore (not shown) in the first halve 540 and in an opening 558 in the second halve 542. By providing the fasteners in the first and second halves 540 and 542, the first and second halves can be used with third and fourth halves of varying geometries.

The third and fourth halves 560 and 562 may be connected around the putter by angled projections 572 on the fourth halve that are received in correspondingly angled slots 574 in the third halve in a puzzle piece manner. Once connected the third halve 560 is secured to the first halve 540 by a mechanical feature, such as by protrusions 576 projecting downward from the third halve 560 at the first end 568 that are received in slots 578 in the first halve 540 at the second end 564.

Figure 27:
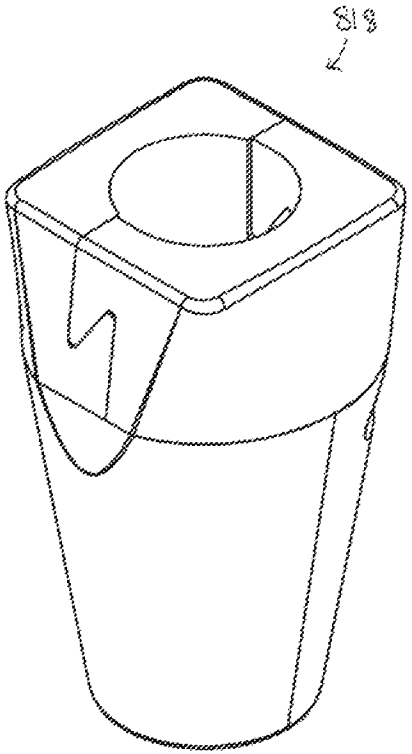
FIG. 27 is a perspective view of a further exemplary grip accessory.
Figure 26:
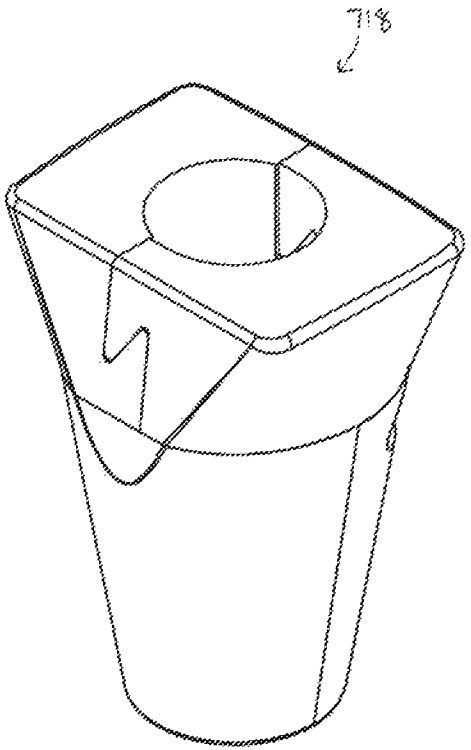
FIG. 26 is a perspective view of still another exemplary grip accessory.
Figure 25:
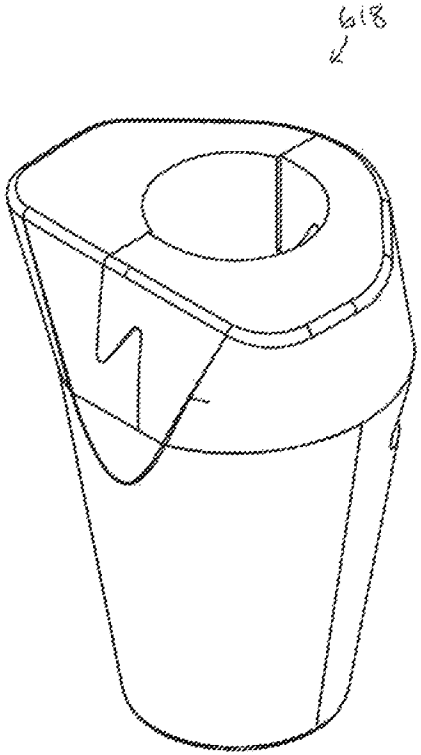
FIG. 25 is a perspective view of yet another exemplary grip accessory.

Turning now to FIGS. 25-27, exemplary embodiments of the taper portion are shown at 618, 718, and 818 respectively. The taper portions 618, 718, and 818 are substantially the same as the above-referenced taper portion 418, and consequently the same reference numerals but indexed by 200, 300, and 400 respectively are used to denote structures corresponding to similar structures in the portions. In addition, the foregoing description of the taper portion 418 is equally applicable to the taper portions 618, 718 and 818 except as noted below.

FIG. 25 illustrates a taper portion 618 with a second end having an isosceles right pentagon geometry, FIG. 26 illustrates a taper portion 718 with a second end having a rectangular geometry, and FIG. 27 illustrates a taper portion 818 with a second end having a square geometry.

Although certain embodiments have been shown and described, it is understood that equivalents and modifications falling within the scope of the appended claims will occur to others who are skilled in the art upon the reading and understanding of this specification.

What is claimed is:

1. A grip for a golf club including:

a body including:

a grip portion having first and second ends with a pair of longitudinally extending parallel flat sides extending from the first end to the second end and each joined to a pair of longitudinally extending curved sides that are mirror images of one another and extending from the first end to the second end, and a bore extending longitudinally through the grip portion for a shaft of the golf club, a taper portion adjacent to the first end of the grip portion tapering away from the grip portion and having a bore in communication with the bore of the grip portion, and an end portion having a first end adjacent to the second end of the grip portion, a second end spaced from the first end, a bore extending longitudinally through the end portion, and a vent passage in communication with and substantially perpendicular to the bore and opening to an outer surface of the end portion; and a wrap surrounding the grip portion, the wrap having an outer surface substantially flush with an adjacent outer surface of the taper portion and an adjacent outer surface of the end portion, wherein the taper portion and the end portion each have a cross-sectional area adjacent the first and second ends of the grip portion respectively that is greater than a cross-sectional area of the grip portion, wherein the grip portion and end portion are one piece, and wherein the bore of the end portion is in communication with the bore of the grip portion.

2. The grip according to claim 1, further include a plug secured to the grip portion at the second end to close off the bore of the end portion to prevent air and/or solvent from escaping the bore at the second end.

3. The grip according to claim 1, wherein the bore of the grip portion has a first diameter and the bore of the end portion has a second diameter less than the first diameter.

4. The grip according to claim 1, wherein the grip portion, the taper portion, and the end portion are one piece.

5. The grip according to claim 1, wherein the grip portion and the taper portion are separate pieces.

6. The grip according to claim 1, wherein the grip portion and the taper portion are separate pieces, wherein the taper portion includes an upper portion configured to abut the grip portion, and a lower portion configured to abut the upper portion, and wherein the upper portion includes first and second halves configured to connect together around the shaft and the lower portion includes third and fourth halves configured to connect together around the shaft.

7. The grip according to claim 1, wherein the grip portion and the taper portion are separate pieces, wherein the taper portion includes an upper portion configured to abut the grip portion, and a lower portion configured to abut the upper portion, and wherein the upper portion has a first end configured to abut the lower portion and a second end configured to abut the first end of the grip portion, wherein the first end of the upper portion has a geometry that matches a geometry of the first end of the grip portion, and wherein the second end of the upper portion has a substantially circular geometry.

8. The grip according to claim 1, wherein the elongate body is substantially obround in shape such that the cross-sectional shape of the body has two parallel lines of equal length and two arcs that are mirror images of one another and whose chords are less than a full diameter.

9. The grip according to claim 1, wherein the end portion has a first end adjacent to the second end of the grip portion and a second end opposite the first end, and wherein the second end is closed such that air only exits the end portion via the vent passage.

10. The grip according to claim 1, wherein the end portion includes a counterbore at the first end opening to the bore, and wherein the plug is disposed in the counterbore.

11. A golf club grip including:

an elongate body having an axial length, first and second ends, an opening at the first end, and a counterbore at the second end;

an axial passage within the body extending substantially the length of the body, the passage having a first end that opens to the opening at the first end of the body to allow a shaft of a golf club to be advanced into the axial passage and a second end that opens to the counterbore at the second end;

an air passage extending through inner and outer surfaces of the body perpendicular to and into the axial passage to allow air to escape the grip from the axial passage as the shaft of the golf club is advanced into the axial passage; and a plug disposed in the counterbore and secured to the second end to close the second end of the axial passage without blocking communication between the air passage and the axial passage, wherein the inner surface of the body forms the axial passage and the outer surface of the body surrounds the inner surface.

12. The golf club grip according to claim 11, wherein the air passage is proximate the second end of the body.

13. The golf club grip according to claim 11, wherein the air passage is substantially perpendicular to the axial passage.

14. The golf club grip according to claim 11, wherein the axial passage includes a first portion having a first diameter substantially equal to a diameter of the shaft of the golf club and a second portion having a second diameter less than the first diameter.

15. The golf club grip according to claim 11, wherein the elongate body has a first portion with a first cross-sectional area, a second portion proximate the first end with a second cross-sectional area, and a third portion proximate the second end with a third cross-sectional area, and wherein the cross-sectional areas of the second and third portions are greater than the cross-sectional area of the first portion.

16. The golf club grip according to claim 11, wherein the plug includes a first portion perpendicular to the axial passage and a second portion parallel to the axial passage.

17. The golf club grip according to claim 11, wherein the plug has a first portion with a geometry that matches a geometry of the counterbore to close the counterbore, and a second portion with a geometry matching a geometry of the axial passage adjacent the counterbore and which extends into the axial passage.

18. The golf club grip according to claim 17, wherein the counterbore is substantially obround, the first portion of the plug is substantially obround, and the second portion of the plug is substantially cylindrical.

19. The golf club grip according to claim 11, wherein the counterbore and the plug are substantially obround.

* * * * *